United States Patent [19]

Colton

[11] 4,449,556

[45] May 22, 1984

[54] ROTARY CUTTER HEADS

[75] Inventor: Peter M. Colton, Leicester, England

[73] Assignee: Wadkin plc, Leicester, England

[21] Appl. No.: 425,504

[22] Filed: Sep. 28, 1982

Related U.S. Application Data

[63] Continuation-in-part of Ser. No. 409,994, Aug. 20, 1982, abandoned.

[51] Int. Cl.[3] ..... B27G 13/04

[52] U.S. Cl. ..... 144/230; 144/231; 407/41; 407/93; 407/106

[58] Field of Search ..... 144/218, 230, 231; 407/37, 38, 39, 41, 50, 93, 106, 108, 109

[56] References Cited

U.S. PATENT DOCUMENTS

| | | | |
|---|---|---|---|
| 2,314,665 | 3/1943 | Specht | 407/93 |
| 2,805,468 | 9/1957 | Williams | 407/41 |
| 2,814,320 | 11/1957 | Dukes et al. | 144/230 |
| 2,917,091 | 12/1959 | Smith et al. | 144/230 |
| 3,378,901 | 4/1968 | Dupuis | 407/93 |
| 3,588,976 | 6/1971 | Dupuis et al. | 407/93 |
| 3,980,443 | 9/1976 | McCreery | 407/106 |
| 4,078,868 | 3/1978 | Erkfritz | 407/41 |
| 4,329,091 | 5/1982 | Erkfritz | 407/41 |

*Primary Examiner*—W. D. Bray

[57] ABSTRACT

In a rotary cutter block a blade is clamped in an inwardly divergent recess by a wedge. A spring positioned between the cutter block and the wedge takes up any slack when the wedge is loosened thereby eliminating the need for operator manipulation of the wedge, blade and optional backing plate for the blade during setting of the blade. Also provided is a cam means for incrementally adjusting the blade outwardly of the cutter block.

26 Claims, 4 Drawing Figures

ROTARY CUTTER HEADS

CROSS-REFERENCE TO RELATED APPLICATION

This application is a continuation-in-part of application Ser. No. 409,994 filed Aug. 20, 1982 and now abandoned.

This invention relates to rotary cutter heads for woodworking machinery, and provides a novel method of blade anchorage and adjustment for such cutter heads.

Rotary cutters for woodworking machinery may be of one-piece construction or may be provided with removable and adjustable cutter blades. The latter form of rotary cutter is advantageous in that worn or broken blades may be replaced, and moreover the blades may be adjusted radially outwardly in blade-receiving recesses or housings in a cutter block, to compensate for blade wear. For many years the retention of such blades by wedge means has been known, with each blade and its associated wedge being received in an inwardly divergent blade-receiving recess in the cutter block. The wedging action is such that with increasing rotational speeds the wedges are urged outwardly by centripetal force, to bear with increasing force on the blades received in the same blade-receiving recesses. Thus with higher rotational speeds the blades are anchored progressively more firmly, although the anchorage throughout is merely frictional, between one face of the blade and the wedge on the one hand and the other face of the blade and the cutter block on the other hand. Friction is not always sufficient to retain the blades firmly in their blade-receiving recesses at high rotational speeds, so that a method of positive blade anchorage has been proposed which comprises forming the cooperating faces of the blade and the cutter block with cooperating axial serrations. The blade is thus keyed to the block in a manner which, by virtue of the wedging action of the wedges, completely prevents the blades from moving outwardly of their recesses in use. The machining of axial serrations in the blade also provides means for positively aligning the blades axially of the block, thus preventing twisting of the blade in use.

One disadvantage of this method of blade mounting is that when the wedges are slackened in the blade-receiving recesses, by the partial release of a tightening screw or bolt, the blades must be withdrawn axially from the block and reinserted axially in their new radially outer positions. This can be a time-consuming operation, since the wedges become loose when the blades are removed, and tend to interfere with the reinsertion of the blades. The tightening bolts can of course be slackened further until the respective serrations on the blade and block can ride over one another, but this also can be time-consuming as the blades have to be held manually in axial alignment with the serrations on the block while the tightening screws or bolts are re-tightened to cause re-engagement of the respective serrations.

Another disadvantage of the above method of blade mounting is the incremental nature of the blade advancement. This means that either a complete serration pitch must be removed from the blade each regrinding operation or a variation in the cutting diameter of the cutter must be tolerated with successive regrinding operations. Each change in the cutting diameter does of course involve an allied resetting operation of the woodworking tool, in order to cut the timber to a constant specified size, and this increases operating costs and introduces an additional possibility of human error. British Patent Specification No. 814,580 proposes the use of a screw-adjustable backing plate for the blade to overcome the problem of incremental blade advancement, but this is at the expense of the axial blade alignment that would otherwise be provided by the cooperating serrations.

It is an object of the invention to provide a rotary cutter head for woodworking machinery, in which the blades do not fall around in the divergent recesses in the cutterblock when the clamp means are slackened.

In a further object of the invention to permit controlled incremental advancement of the blades from the divergent recesses when the clamp means are slackened.

It a further object of the invention to attain the above advantages without loss of security of clamping of the blade means in the divergent recesses.

These and other objects of the invention are attained by a rotary cutter head for woodworking machinery, comprising

- a cylindrical cutterblock body,
- a plurality of inwardly divergent recesses formed in the cutterblock body and, in each recess,
- a cutter blade,
- clamp means comprising a wedge and screw means associated with the wedge, the screw means being tightenable against a face of the recess to urge the wedge into direct contact with the cutter blade to clamp the blade in the recess, and
- resilient means acting on the clamp means, lightly to hold the cutter blade in position on slackening of the screw means.

In a preferred embodiment of the invention the resilient means each comprises a spiral spring and ball bearing in a rearwardly facing housing formed in the wedge, the ball bearing serving to maintain the spring captive in the housing. The use of conventional ball catches is quite suitable.

In a preferred aspect of the invention, the rear faces of the blades are axially serrated and cooperate with mating serrations in a backing plate that is keyed to the cutterblock and can be advanced incrementally therefrom. The incremental advancement must be achieved while maintaining the entire cutterblock assembly in precise balance, and one very satisfactory method is by using a rotary cam member on the cutterblock body, cooperating with a cam slot in the backing plate to move the backing plate incrementally over a distance of at least half the pitch of the serrations on the blade and backing plate. The maximum accuracy of adjustment is achieved when the range of movement of the backing plate is exactly half the pitch of the serrations, but for operator convenience the range of movement is preferably a complete pitch, and cooperating markings are preferably provided on the cam and the cutterblock body to provide a visual check on the angle of rotation of the cam and thus the extent of advancement of the associated blade from the cutterblock body. This visual check is important for balancing purposes, since it would otherwise be possible to have one backing plate fully advanced from the cutterblock body and the other fully withdrawn, while the blades came to the same radii by engagement of different sets of serrations with the respective backing plates.

DRAWINGS

Figure 1:
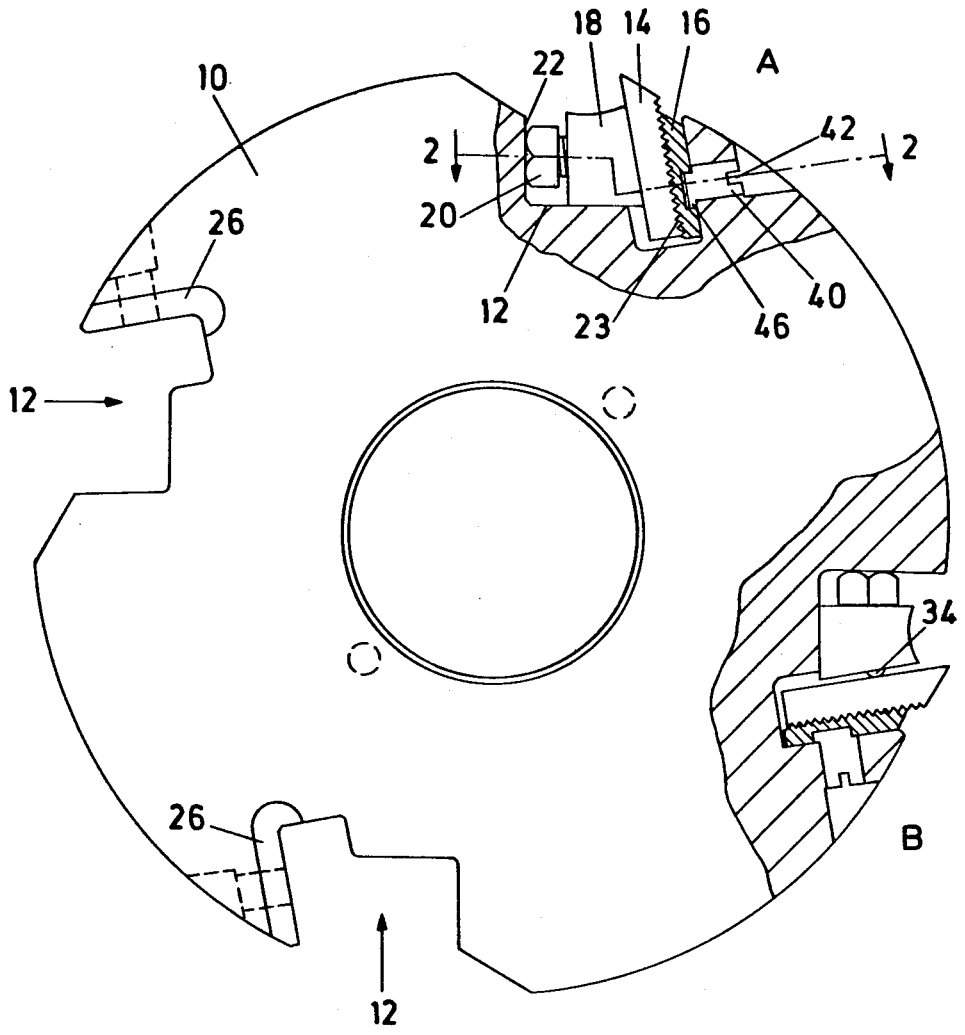
FIG. 1 is a side elevation, partly sectioned, of a rotary cutter head according to the invention.

FIG. 1 shows a rotary cutterblock 10 having four blade-receiving recesses 12 equally spaced around its periphery. In one of these, labelled A, a blade assembly is clamped ready for use, whereas in another, labelled B, a similar blade assembly is shown unclamped for adjustment. The other two blade-receiving recesses are shown schematically only, and in use would receive identical blade assemblies.

Each recess 12 is inwardly divergent, and each blade assembly contained therein comprises a blade 14, a backing plate 16, a wedge 18 and a screw 20. The screw bears against a face 22 of the recess 12 to urge the wedge 18 into contact with the blade 14 and the backing plate into contact with an opposite wall of the recess 12, thus clamping the blade 14 firmly in the recess.

Positive location of the blade 14 in use is achieved by cooperating axial serrations 23 on the rear face of the blade and the forwardly facing face of the backing plate 16. Axial alignment of the backing plate is achieved by keying it to the cutterblock 10 through side flanges 24 (FIG. 2) of the backing plate 16 which are received in milled slots 26 (FIG. 1) in the cutterblock.

Figure 2:
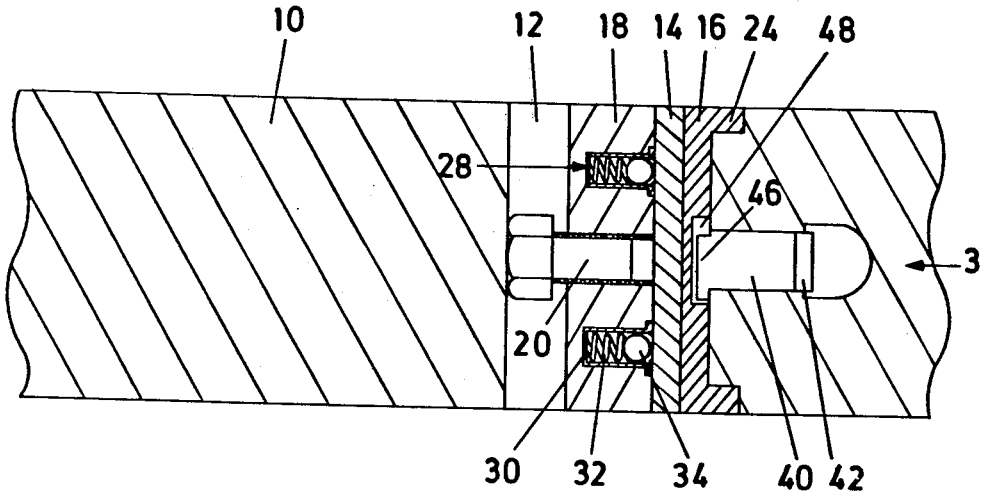
FIG. 2 is a staggered section taken along the line 2—2 of FIG. 1.

As seen in FIG. 2, each wedge 18 contains a pair of recessed ball catches 28 each comprising a flanged cylindrical housing 30 containing a captive spring 32 and ball 34. As shown in FIG. 2, and in blade-receiving recess A of FIG. 1, the springs 32 are compressed and the balls 34 wholly received within the housing 30 when the wedge 18 is clamped against the blade 14. However when the screw 20 is slackened the springs 32 move the wedge 18 away from the blade 14 as shown at B in FIG. 1. This lightly maintains the blade 14 in its operative position, but permits outward movement of the blade from the recess 12, while the serrations on the blade 14 and backing plate 16 ride over one another in a manner which involves the minimum of manipulation by the operator.

Incremental adjustment of the blades 14 can be achieved utilizing an eccentric cam 40 which can be turned by means of a screwdriver slot 42. The cam has a cylindrical body and an eccentric end portion 46 which is received in an elongate blind milled slot 48 in the rear face of the backing plate 16. The extent of movement of the backing plate 16 that can be achieved by means of the cam 40 is one serration pitch (although the eccentricity of the cam is exaggerated in the drawings for illustrative purposes) so that a fully continuous range of blade positions is obtainable by different combinations of cam rotational positions and interengagement of different serrations of the blade and backing plate.

Figure 3:
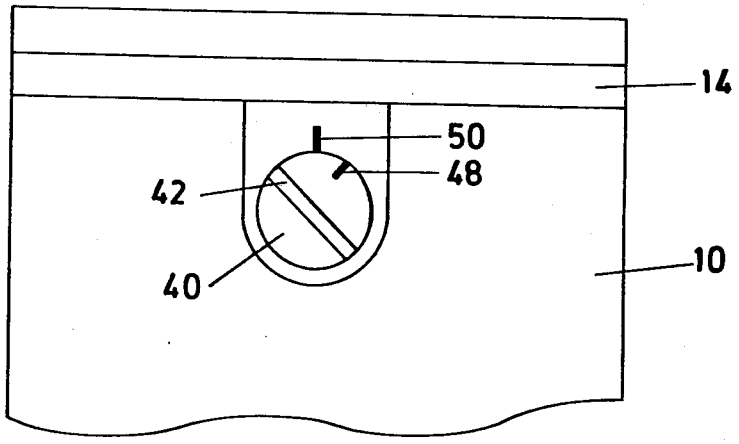
FIG. 3 is a detail from an end elevation of the cutter head, viewed in the direction of arrow 3 of FIG. 2.

The rotational balance of the assembled cutter head is important, so the cam 40 is provided with a positioning mark 48 and the cutterblock body 10 with a corresponding positioning mark 50 as seen in FIG. 3. This enables the operator to maintain the various cams 40 around the cutterblock body 10 in the same relative angular positions rather than have one displaced 180° relative to the others.

The use of the cutter head illustrated in the drawings enables an operator easily and rapidly to set all the blades to a precise radius either before or after grinding. For greatest accuracy the blades are set to a radius marginally greater than that desired, and the excess removed by grinding to bring all blades to the exact radius. However the simplicity of advancing the blades a complete serration or more at a time, and of subsequently achieving a fine adjustment of the setting of individual blades using the cams 40, makes it quite acceptable for all but the most exacting job specifications to set pre-ground blades to the desired radius.

Figure 4:
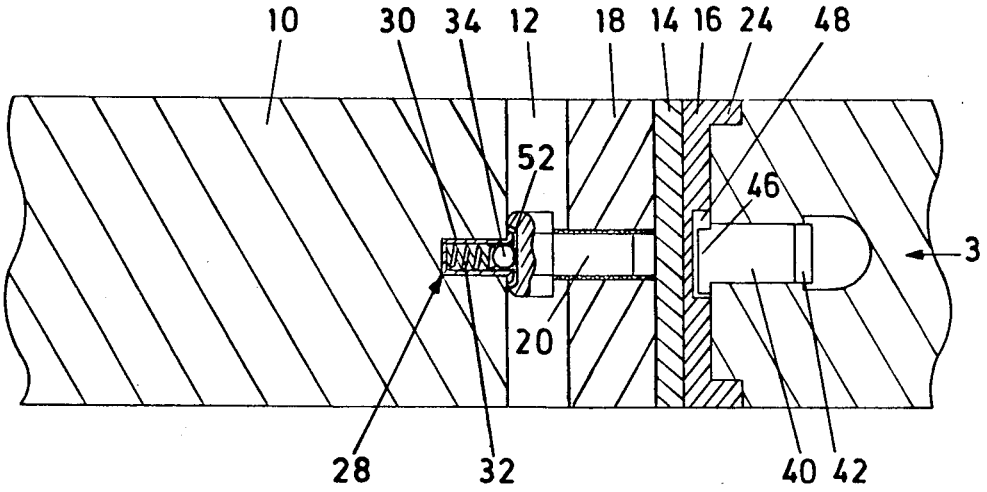
FIG. 4 is a staggered section corresponding to that of FIG. 2, through another embodiment of the invention.

FIG. 4 shows a detail of another embodiment of the invention, in which the parts and reference numerals are the same as those of FIGS. 1 to 3. In FIG. 4, the pair of ball catches of FIG. 2 is replaced by a single ball catch 28 comprising a flanged cylindrical housing 30 containing a captive spring 32 and ball 34. The ball catch 28 of FIG. 4 is recessed not in the wedge 18 but in the cutterblock 10, and the ball 34 in use bears against the screw 20. As shown in FIG. 4, with the screws 20 tightened, the ball 34 is wholly received in the housing 30. A flanged head 52 of the housing protrudes from the cutterblock 10, and the head of the screw 20 is recessed to accommodate such a protrusion and allow the screw to bear directly on the cutterblock 10 and not on the head 52.

When the screw 20 is slackened, the ball catch 28 urges the entire clamp means of screw 20 and wedge 18 to the right as viewed in FIG. 4, lightly to hold the blade 14 in position.

I claim:

1. A rotary cutter head for woodworking machinery comprising:
   - a cylindrical cutterblock body;
   - a plurality of inwardly divergent recesses formed in said cutterblock body;
   - a cutter blade positioned in each of said recesses;
   - clamp means in each of said recesses, said clamp means each comprising a wedge and screw means associated with the wedge, the screw means being tightenable against a face of a recess to urge the wedge into direct contact with an associated cutter blade positioned in the said recess to clamp the blade in the recess; and
   - resilient means in each recess, each resilient means acting on an associated clamp means to lightly hold the cutter blade in position on slackening of the associated screw means.

2. A rotary cutter head according to claim 1, wherein each of said wedges defines a housing and each of said resilient means is received wholly within the housing in its respective wedge when the respective screw means is tightened against a face of a recess, the resilient means extending partially from its associated housing into contact with the cutter blade when the said screw means is slackened to thereby hold the cutter blade lightly in position in its cutterbody block recess.

3. A rotary cutter head according to claim 1, wherein said cutterblock body defines housings for said resilient means and wherein each of said resilient means is received wholly within a housing in the cutterblock body when its associated clamp means screw means is tightened against the said face of a cutterblock body recess, said resilient means extending partially from the housings into contact with respective clamp means when the said screw means is slackened to thereby bias the clamp means to hold the cutter blade lightly in position in its cutterblock body recess.

4. A rotary cutter head according to claim 2 or claim 3, wherein each resilient means comprises a spiral spring acting on a bearing member, and each housing opens in a direction facing the associated cutter blade.

5. A rotary cutter head according to claim 4, wherein each bearing member is a ball bearing.

6. A rotary cutter head according to claim 5, wherein each ball bearing holds it associated spring captive in its housing.

7. A rotary cutter head according to claim 1, wherein the face of each cutter blade remote from the clamp means is axially serrated and cooperates with similar axial serrations on an opposing face of the divergent recess.

8. A rotary cutter head according to claim 1, wherein the face of each cutter blade remote from the clamping means is axially serrated and wherein said cutter head further comprises a backing plate disposed in each of said divergent recesses, said backing plates being provided with axial serrations which cooperate with the serrations on the faces of the cutter blades.

9. A rotary cutter head according to claim 8, further comprising adjusting means for moving the backing plates incrementally in and out of the divergent recesses.

10. A rotary cutter head according to claim 9, wherein the adjusting means comprises a rotary cam member cooperable with a cam slot in the backing plate to move the backing plate incrementally into or out of the slot over a distance of at least half the pitch of the serrations of the blade and backing plate.

11. A rotary cutter head according to claim 10, wherein the rotary cam and cutterblock body are provided with cooperating markings to provide a visual check on the angle of rotation of the cam and thus the extent of advancement of the backing plate from the cutterblock body.

12. A rotary cutter head according to claim 9 wherein the backing plate is keyed to the cutterblock body for precise axial alignment of its serrations with the axis of the cutterblock body.

13. A rotary cutter head according to claim 10 wherein the backing plate is keyed to the cutterblock body for precise axial alignment of its serrations with the axis of the cutterblock body.

14. A rotary cutter head according to claim 11 wherein the backing plate is keyed to the cutterblock body for precise axial alignment of its serrations with the axis of the cutterblock body.

15. A rotary cutter head for woodworking machinery, comprising a cutterblock body formed with a number of inwardly divergent recesses each receiving a cutter blade held therein by clamp means, wherein each clamp means comprises a wedge and associated screw means for clamping the cutter blade in the recess, and each clamp means incorporates at least one resilient means extending partially from a recess in the wedge to hold the cutter blade lightly in position on slackening of the screw means.

16. A rotary cutter head according to claim 15, wherein each wedge recess is a blind recess opening towards the associated cutter blade, and each resilient means comprises a spiral spring in the associated wedge recess, the resilient means being received wholly within the wedge recesses when the screw means are tightened to clamp the blades in the cutterblock body.

17. A rotary cutter head according to claim 16, wherein each resilient means further comprises a bearing member between the wedge and the cutter blade.

18. A rotary cutter head according to claim 17, wherein the bearing members are ball bearings.

19. A rotary cutter head according to claim 18, wherein the ball bearings hold the springs captive in the wedge recesses.

20. A rotary cutter head according to claim 15, wherein the rear face of each cutter blade is axially serrated and cooperates with similar axial serrations on a forwardly facing face of the divergent recess.

21. A rotary cutter head according to claim 15, wherein the rear surface of each cutter blade is axially serrated and cooperates with similar axial serrations on a forwardly facing face of a backing plate disposed in the divergent recess, the backing plates being movable incrementally in and out of the divergent recesses by adjusting means.

22. A rotary cutter head according to claim 21, wherein the adjusting means comprises a rotary cam member cooperable with a cam slot in the backing plate to move the backing plate incrementally into or out of the slot over a distance of at least half the pitch of the serrations of the blade and backing plate.

23. A rotary cutter head according to claim 22, wherein the rotary cam and cutterblock body are provided with cooperating markings to provide a visual check on the angle of rotation of the cam and thus the extent of advancement of the backing plate from the cutterblock body.

24. A rotary cutter head according to claim 21, wherein wherein the backing plate is keyed to the cutterblock body for precise axial alignment of its serrations with the axis of the cutterblock body.

25. A rotary cutter head according to claim 22, wherein wherein the backing plate is keyed to the cutterblock body for precise axial alignment of its serrations with the axis of the cutterblock body.

26. A rotary cutter head according to claim 23, wherein wherein the backing plate is keyed to the cutterblock body for precise axial alignment of its serrations with the axis of the cutterblock body.

* * * * *